US005734315A

United States Patent [19]

Skeen

[11] Patent Number: 5,734,315

[45] Date of Patent: Mar. 31, 1998

[54] TRACK ALERT SYSTEM FOR AUTOMOBILE RACING

[76] Inventor: Wayne D. Skeen, 901 Rim Rock Rd., Bailey, Colo. 80421-2143

[21] Appl. No.: 559,907

[22] Filed: Nov. 17, 1995

[51] Int. Cl.[6] ..... G08B 23/00

[52] U.S. Cl. ..... 340/323 R; 340/539; 340/902; 340/825.69; 472/85

[58] Field of Search ..... 340/323 R, 902, 340/539, 825.69, 825.72; 455/34.1, 166.1; 463/6; 472/85

[56] References Cited

U.S. PATENT DOCUMENTS 4,785,282 11/1988 Martell et al. ..... 340/323 R
4,794,394 12/1988 Halstead ..... 340/902
5,172,113 12/1992 Haner ..... 340/907

*Primary Examiner*—Donnie L. Crosland
*Attorney, Agent, or Firm*—William E. Hein

[57] ABSTRACT

A track alert system for automobile racing employs a transmitter for transmitting a selected one of a plurality of channel signals, each of which is indicative of a particular race track flag condition, a receiver capable of receiving each of the transmitted channel signals, and a priority/tone generator coupled to the receiver for prioritizing two or more simultaneously received channel signals and for generating a particular tone corresponding to a received, prioritized channel signal. The transmitter is fixedly positioned at a chosen location on a race track and is controlled by a track flag operator. A receiver and priority/tone generator are mounted in each of the race cars participating in a race. The generated tone corresponding to a track flag condition is received through an ear piece worn by each race car driver. A reset switch mounted in each race car enables the driver to turn off a generated tone once it has been recognized.

3 Claims, 3 Drawing Sheets

TRACK ALERT SYSTEM FOR AUTOMOBILE RACING

BACKGROUND AND SUMMARY OF THE INVENTION

This invention relates generally to automobile track racing and, more particularly, to a remotely operated audible warning device that serves to alert all race car drivers to hazards on the track, such as an accident or debris, for example.

Race car track warning systems are presently visual in nature and typically utilize manual flagging from a flagger stand and/or a corner station. In addition, some warning systems employ yellow and red warning lights positioned outside the perimeter of the track. As racing has become more competitive, involving progressively higher speeds, these prior art visual systems have become inadequate. The risk of drivers not seeing a displayed flag or warning light is increasingly higher, since drivers must focus primarily on negotiating corners and avoiding traffic. Some prior art track warning systems have attempted to address these problems by placing lights in each car and around the track. These systems are disadvantageous in that the lights are difficult to see during daytime races. In addition, they convey no information to the drivers as to how long a warning light has been activated. Moroever, these systems do not have the ability of simultaneously warning all drivers participating in a race.

It is therefore the principal object of the present invention to provide a race car track warning system that provides reliable audio means to simultaneously notify all participating drivers of track hazards.

This and other incidental objects are accomplished in accordance with the illustrated preferred embodiment of the present invention by providing a transmitter for transmitting a selected one of a plurality of channel signals, each of which is indicative of a race track flag condition, a receiver capable of receiving each of the transmitted channel signals, and a priority/tone generator coupled to the receiver for prioritizing two or more simultaneously received channel signals and for generating a particular tone corresponding to a received, prioritized channel signal. The transmitter is fixedly positioned at a chosen location on a race track and is controlled by a track flag operator. A receiver and priority/tone generator are mounted in each of the race cars participating in a race. The generated tone corresponding to a track flag condition is received through an ear piece worn by each race car driver.

DESCRIPTION OF THE PREFERRED EMBODIMENT

Figure 1B:
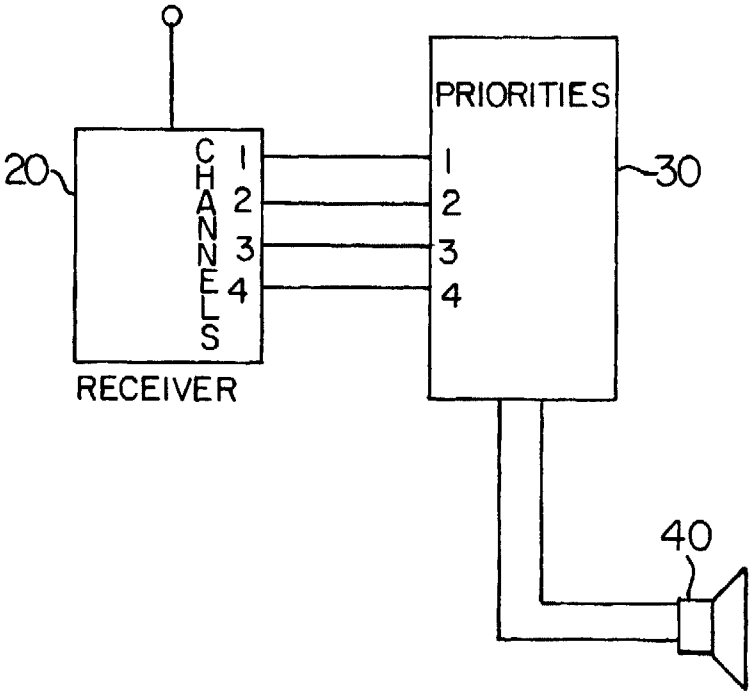
FIG. 1B is a pictorial diagram of a receiver and priority/tone generator employed in the track alert system of the present invention.
Figure 1A:
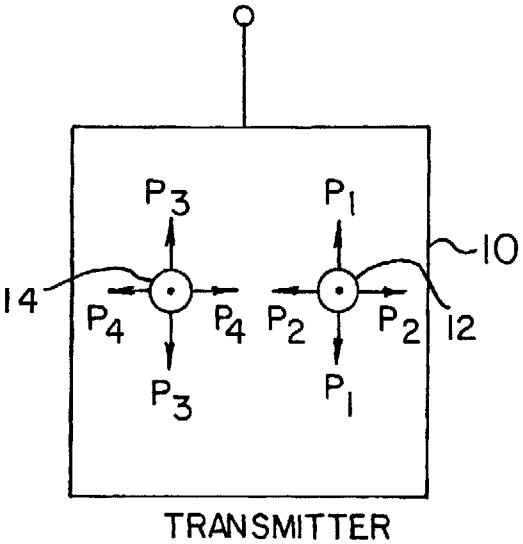
FIG. 1A is a pictorial diagram of a transmitter that is fixedly positioned at a particular location on a race track, in accordance with the present invention.

Referring now to FIG. 1A, there is shown a transmitter 10 that is employed in the track alert system of the present invention. Transmitter 10 may comprise any of a number of commercially available RC hobby transmitters, such as the Futaba model T6NFK transmitter, for example. Transmitter 10 is fixedly positioned at a chosen location on a race track and is controlled by a track flag operator. A pair of joysticks 12, 14 on the panel of transmitter 10 serve to select a particular channel on which a signal is to be transmitted. Each of the channel corresponds to a conventional race track flag conditions. For example, channel 1, selected by moving joystick 12 of transmitter 10 to either of the positions designated P1, may be chosen to correspond to a red flag condition. Channel 2, selected by moving joystick 12 to either of the positions designated P2, may be chosen to correspond to a yellow flag condition. Channels 3 and 4, selected by similarly moving joystick 14, may be chosen to correspond to other flag conditions.

Referring now to FIG. 1A, there is shown a receiver 20, a priority/tone generator 30, and an ear piece 40 that are also employed in the track alert system of the present invention. These components of the track alert system are located in each of the participating race cars. Receiver 20 may comprise any of a number of commercially available RC hobby receivers, such as the Futaba model T6NFK receiver, for example. Receiver 20 receives a signal transmitted on each of the four channels on which transmitter 10 is capable of transmitting. Each of the received signals is available as a channel output on receiver 20.

Figure 2A:
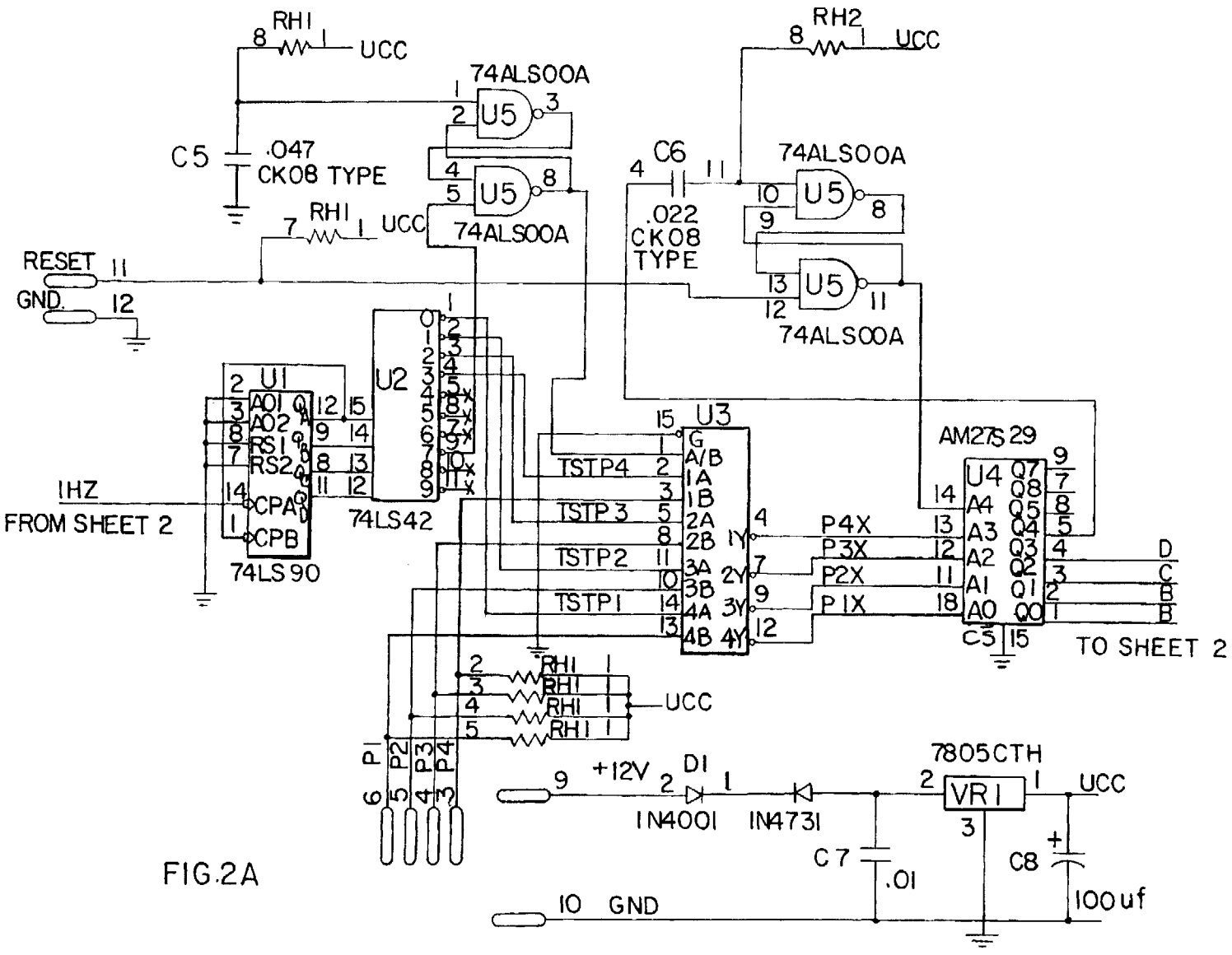
FIGS. 2A and 2B are a detailed schematic diagram of the priority/tone generator of FIG. 1B.
Figure 2B:
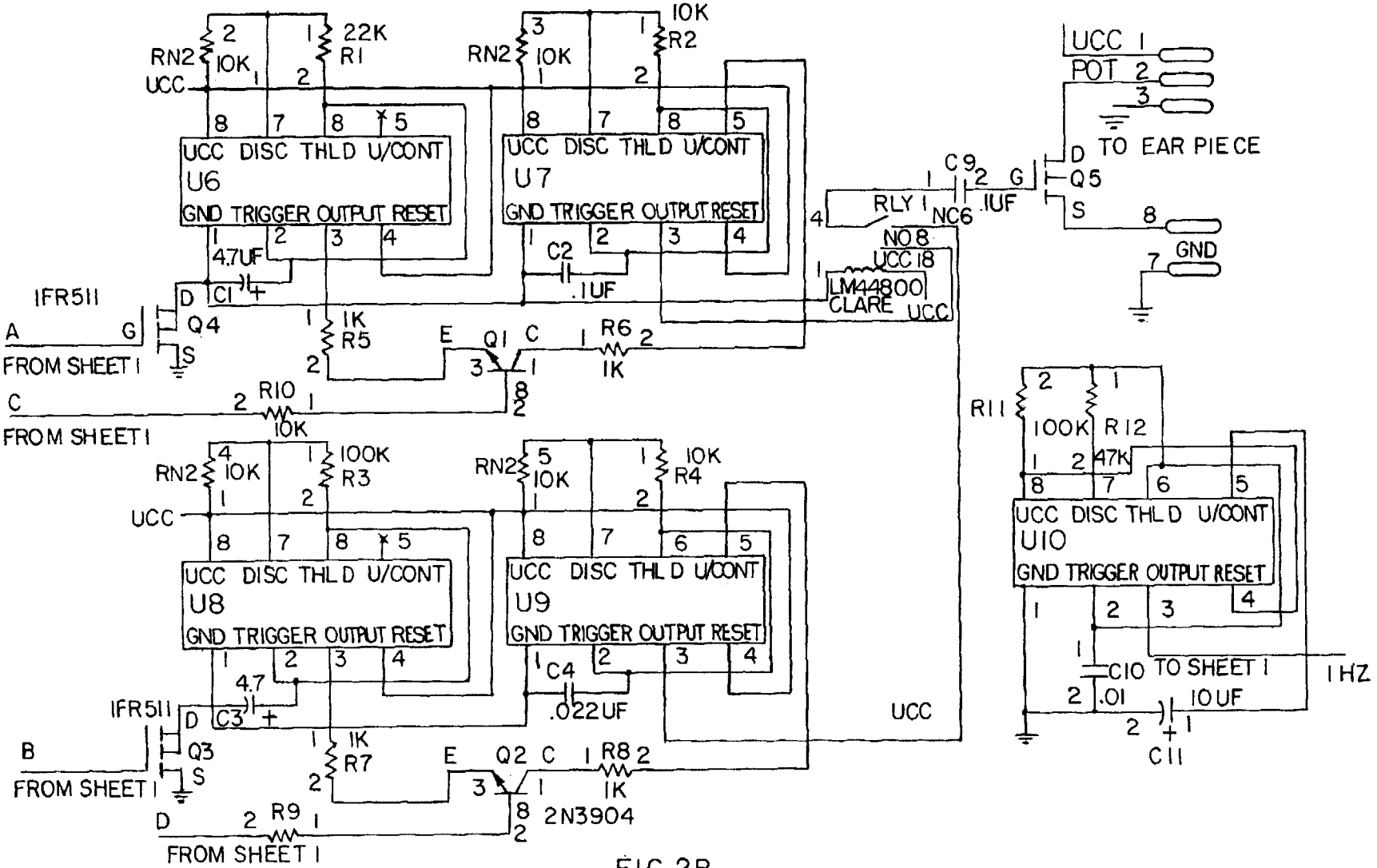

The received signals, corresponding to channel outputs 1–4 are coupled to priority/tone generator 30, a detailed circuit diagram of which is shown in FIGS. 2A–B. Priority/tone generator 30 serves to prioritize each of the channel signals transmitted by transmitter 10 and received by receiver 20 and to generate a corresponding audible flag tone that is outputted by ear piece 40 to the race car driver. The components illustrated in the circuit diagram of FIGS. 2A–B are all available as off-the-shelf electronic components. Logic chips U1–U5 are arranged in a conventional manner to determine the priority to be given to the received channel signals 1–4. In accordance with this circuit, the channel signal having the highest priority overrides any lower priority channel signal in the event that two or more signals are received at the same time. For example, a channel 1 signal would override any other channel signal, and a channel 2 signal would override either a channel 3 or channel 4 signal. The prioritized channel signal received by receiver 20 is applied to chips U6–U9 that may comprise off-the-shelf LM555 timer chips, for example, and that serve to generate a distinct tone corresponding to that prioritized channel signal. A channel 1 signal results in a tone generated by outputs B+D of chip U4; a channel 2 signal results in a tone generated by output B of chip U4; a channel 3 signal results in a tone generated by outputs A+C of chip U4; and a channel 4 signal results in a tone generated by output A of chip U4. The generated tones representative of flag conditions initiated by the track flag operator are heard over ear piece 40 worn by each race car driver. The circuit of FIGS. 2A–B also provides an input from an external reset switch that is located in each race car that allows the driver to turn off a tone once it has been recognized. Chip U5 serves as a latch to perform this function. A voltage regulator chip VR1 is employed in a conventional manner to supply the circuitry of FIGS. 2A–B with a constant operating voltage.

The track alert system of the present invention may also be employed to alert drivers of vehicles in the area of street and highway intersections of the approach of an emergency vehicle such as a fire truck, police car, ambulance, etc. In this application, transmitter 10 would be located in each such emergency vehicle, and the receiver 20 and associated circuitry of FIG. 1B would be located in every other vehicle.

In use, the driver of the emergency vehicle would simply activate the transmitter 10 located in his vehicle as it approaches an intersection. The resultant tone would be heard by drivers of all other vehicles in the vicinity that are equipped with the receiver circuitry of FIG. 1B. In this application, ear piece 40 may be replaced by a speaker which may comprise, for example, the one or more speakers of a conventional radio or music system installed in most of today's vehicles. Alternatively, the speaker may be separately installed for this application.

I claim:

1. A track alert system for automobile racing, the track alert system comprising:

a transmitter fixedly positioned proximate a race track for being controlled by a track flag operator, the transmitter being operative for transmitting one or more of a plurality of channel signals selected by the track flag operator, each transmitted channel signal being indicative of a particular race track flag condition; and receiver means mounted in each of a plurality of participating race cars for receiving each of the transmitted channel signals, the receiver means including priority circuit means for prioritizing two or more simultaneously received channel signals and tone generation circuit means for generating a particular audible tone corresponding to a received, prioritized channel signal, said receiver means further comprising an ear piece worn by each race car driver for communicating the generated audible tone to the driver.

2. A track alert system for automobile racing as in claim 1 wherein said receiver means further comprises reset circuitry and a reset switch operative by the driver for turning off a generated tone following its recognition.

3. A method for alerting race track drivers of a flag condition on the track, the method comprising:

providing a transmitter fixedly positioned proximate the race track for being controlled by a track flag operator;

transmitting one or more of a plurality of channel signals selected by the track flag operator, each transmitted channel signal being indicative of a particular race track flag condition; and providing receiver means mounted in each of a plurality of participating race cars for receiving each of the transmitted channel signals, the receiver means including priority circuit means for prioritizing two or more simultaneously received channel signals and tone generation circuit means for generating a particular audible tone corresponding to a received, prioritized channel signal, the receiver means including an ear piece worn by each race car driver for communicating the generated audible tone to the driver.

* * * * *